US007404296B2

(12) United States Patent
Watanabe et al.

(10) Patent No.: US 7,404,296 B2
(45) Date of Patent: Jul. 29, 2008

(54) COOLING DEVICE

(75) Inventors: Yoshiaki Watanabe, Kyoto (JP); Shinichi Sakamoto, Kyoto (JP)

(73) Assignee: The Doshisha

( * ) Notice: Subject to any disclaimer, the term of this patent is extended or adjusted under 35 U.S.C. 154(b) by 344 days.

(21) Appl. No.: 10/550,401

(22) PCT Filed: Mar. 10, 2004

(86) PCT No.: PCT/JP2004/003155

§ 371 (c)(1),
(2), (4) Date: Sep. 23, 2005

(87) PCT Pub. No.: WO2004/085934

PCT Pub. Date: Oct. 7, 2004

(65) Prior Publication Data

US 2006/0185370 A1 Aug. 24, 2006

(30) Foreign Application Priority Data

Mar. 26, 2003 (JP) ..... 2003-084248

(51) Int. Cl.
*F25B 9/00* (2006.01)

(52) U.S. Cl. ..... 62/6

(58) Field of Classification Search ..... 62/6
See application file for complete search history.

(56) References Cited

U.S. PATENT DOCUMENTS 4,455,517 A 6/1984 Mitchell
4,599,551 A 7/1986 Wheatley et al.
5,519,999 A 5/1996 Harpole et al.
5,857,340 A * 1/1999 Garrett ..... 62/6
5,901,556 A * 5/1999 Hofler ..... 62/6
5,953,921 A * 9/1999 Garrett ..... 62/6
6,032,464 A * 3/2000 Swift et al. ..... 60/520

(Continued)

FOREIGN PATENT DOCUMENTS

JP 06-323659 A 11/1994

(Continued)

OTHER PUBLICATIONS

Steven L. Garrett et al. (translated by Shigeru Sida), "Thermoacoustic Refrigeration," Refrigeration vol. 68. No. 788, pp. 26-33 (translation of Ashrae Journal, Dec. 1992), (Jun. 1993).

(Continued)

*Primary Examiner*—William C Doerrler
(74) *Attorney, Agent, or Firm*—Rader, Fishman & Grauer, PLLC

(57) ABSTRACT

The present invention is a cooling device, wherein cooling is effected by enclosing a working fluid in a conduit, which is formed by providing a looped tube formed by interconnecting both respective ends of a stack combining a hot heat exchanger with a cold heat exchanger and a stack combining a cooling heat exchanger with a cooling output heat exchanger and by providing at least one or more acoustic wave generators outside or/and inside the looped tube, and then generating a standing wave and traveling wave in the working fluid, with the present cooling device being primarily capable of markedly shortening the time until the start of generation of the standing wave and traveling wave and providing stable control.

16 Claims, 7 Drawing Sheets

U.S. PATENT DOCUMENTS

| | | | | |
|---|---|---|---|---|
| 6,233,946 | B1 | 5/2001 | Masuda | |
| 6,460,348 | B2 * | 10/2002 | Okamura et al. | 62/6 |
| 6,560,970 | B1 * | 5/2003 | Swift | 62/6 |
| 7,278,271 | B2 * | 10/2007 | Chou et al | 62/6 |
| 2003/0188541 | A1 * | 10/2003 | Howard | 62/6 |

FOREIGN PATENT DOCUMENTS

| | | | |
|---|---|---|---|
| JP | 10-68556 | A | 3/1998 |
| JP | 3015786 | B1 | 12/1999 |
| JP | 3015786 | B1 | 12/1999 |
| JP | 3050543 | B1 | 3/2000 |
| JP | 2000-337724 | A | 12/2000 |
| JP | 2002-535597 | A | 10/2002 |
| JP | 2002-535597 | A | 10/2002 |

OTHER PUBLICATIONS

Steven L. Garrett et al., "The Power of Sound," American Scientist, vol. 88, pp. 516-525 (Nov.-Dec. 2000).
International Search Report mailed on May 25, 2004.
Office Action from Japan Patent Office (Notification of Reasons for Refusal for application No. JP 2005-503996) mailed Apr. 2, 2008 w/English Translation.
Cryogenic Engineering, Carma Publishing (Jun. 30, 1981), p. 21.

* cited by examiner

COOLING DEVICE

TECHNICAL FIELD

The present invention relates to a cooling device utilizing the thermoacoustic effect.

BACKGROUND ART

Cooling devices utilizing the thermoacoustic effect have been attracting attention in view of their high reliability and other advantages due to fewer moving parts in comparison with cooling devices using compressors, etc. In addition, recently, they have been receiving attention from an environmental perspective as cooling devices that permit waste heat utilization and don't use chlorofluorocarbon gases.

As a first conventional technology, there is a thermoacoustic refrigerator made up of a tube, in which inert gas is enclosed as a working fluid, a loudspeaker arranged at one end of the tube, and a stack provided in the vicinity of an end portion of the tube (see, for example, "Thermoacoustic refrigeration", *Refrigeration*, June 1993, Vol. 64, No. 788, by Steven Garrett (Steven L. Garrett), and one other). When the loudspeaker oscillates with a frequency that excites a standing wave inside the tube, the working fluid oscillates back and forth between the plates forming the stack and the pressure associated with the standing wave changes, generating adiabatic compression and adiabatic expansion, as a result of which the thermoacoustic refrigerator is cooled. The problem, however, was that performing heat exchange through efficient conversion of a standing wave to heat inside a stack was not easy.

As a second conventional technology, there is a thermoacoustic refrigerator with two stacks, wherein a standing wave and a traveling wave are generated by spontaneous oscillations in one stack inside a looped tube and a cooling effect is obtained in another stack (see, for instance, "Patent Publication No. 3,015,786"). It is noted that it has taken thermoacoustic refrigerators based on spontaneous oscillation roughly two decades to achieve success (see, for instance, "The Power of Sound (The Power of Sound)" (United States) by Steven Garrett (Steven L. Garrett) and one other, *American Scientist,* 2000, Vol. 88, p. 523, FIG. 8). As can also be gleaned from this, refrigerators utilizing the thermoacoustic effect had serious defects in that not only was it difficult to generate a standing wave and a traveling wave by self-excitation, but a certain time until the start of generation was required as well. It has been thought that the reason for that is due to the fact that the two stacks sandwiched between two heat exchangers in the looped tube that constitutes the device have to be arranged precisely in certain prescribed positions in the looped tube and, at the same time, if the shape etc. of the looped tube does not meet the prescribed requirements, it will not self-oscillate, and the standing wave and traveling wave will not be efficiently converted to heat. In other words, the greatest problem was to determine the requirements for spontaneous oscillation and to create an oscillatable device that would meet the requirements. In addition, another problem was that the device increased in size because the length of the looped tube had to be increased to lower the frequency of oscillation as much as possible and raise the efficiency of the thermoacoustic effect and/or output. Not only was it difficult, as describe above, to generate a standing wave and a traveling wave by self-excitation, but the two problems, i.e. the need for a certain time until the start of generation and the increase in the size of the device, greatly inhibited industrial applicability and impeded practical introduction and widespread use.

DISCLOSURE OF INVENTION

In order to eliminate the above-described problems, it is an object of the invention to provide a cooling device that makes it possible to shorten the time until the start of cooling by readily generating spontaneous oscillation, to improve efficiency, and to achieve miniaturization.

A first invention of the present Application is a cooling device, wherein cooling is effected by enclosing a working fluid in a conduit, which is formed by providing a looped tube formed by interconnecting both respective ends of a stack combining a hot heat exchanger with a cold heat exchanger and a stack combining a cooling heat exchanger with a cooling output heat exchanger and by providing at least one or more acoustic wave generators outside or inside the looped tube, and then generating a standing wave and a traveling wave in the working fluid. The first invention is primarily capable of markedly shortening the time until the start of generation of the standing wave and traveling wave and can provide stable control.

A second invention is the cooling device described above, wherein the acoustic wave generator constitutes part or all of the looped tube.

A third invention is any one of the cooling devices described above, wherein the acoustic wave generator is made of a piezoelectric film. The second and third inventions are primarily capable of implementing cooling devices in a simple and convenient manner and of achieving miniaturization.

A fourth invention is the cooling device described above, wherein the acoustic wave generator has an enclosure provided such that the working fluid, which has a pressure difference relative to pressure inside the looped tube, is placed in communication with the looped tube through a valve or a check valve.

A fifth invention is any one of the cooling devices described above, wherein one or both of the two stacks have oscillation generators.

The sixth invention is not only capable of markedly shortening the time until the start of generation of the standing wave and traveling wave and providing stable control, but is also capable of improving the efficiency of the heat exchangers attached to the stacks and increasing cooling output.

A seventh invention is the above-described cooling device, wherein the oscillation generators are constituted with piezoelectric elements. The seventh invention makes it possible to implement a highly efficient cooling device in a simple and convenient manner.

An eighth invention is any one of the cooling devices described above, wherein one or both of the two stacks are constituted with piezoelectric elements. An eighth invention is any one of the cooling devices described above, wherein one or both of the two stacks are constituted with fluid channels of different fluid channel cross-sectional areas.

A ninth invention is any one of the cooling devices described above, wherein one or both of the two stacks are constituted with fluid channels of smaller fluid channel cross-sectional areas near the center of the stack and fluid channels of larger fluid channel cross-sectional areas towards the periphery of the stack.

A tenth invention is any one of the cooling devices described above, wherein one or both of the two stacks, as well as the hot heat exchanger and cold heat exchanger or/and the cooling heat exchanger and cooling output heat exchanger are constituted with fluid channels of different fluid channel cross sectional areas. In other words, the above is characterized in that the configurations of the three patterns below are constituted with fluid channels of different fluid channel cross-sectional areas. Firstly, one or both of the two stacks, as well as the hot heat exchanger and cold heat exchanger, are constituted with fluid channels of different fluid channel cross-sectional areas. Secondly, one or both of the two stacks, as well as the cooling heat exchanger and cooling output heat exchanger, are constituted with fluid channels of different fluid channel cross-sectional areas. Thirdly, one or both of the two stacks, as well as the hot heat exchanger, cold heat exchanger, cooling heat exchanger, and cooling output heat exchanger, are constituted with fluid channels of different fluid channel cross-sectional areas.

An eleventh invention is any one of the cooling devices described above, wherein one or both of the two stacks are constituted with fluid channels of different stack fluid channel lengths.

A twelfth invention is any one of the cooling devices described above, wherein one or both of the two stacks are constituted with fluid channels of longer fluid channel lengths near the center of the stack and fluid channels of shorter fluid channel lengths towards the periphery of the stack.

A thirteenth invention is any one of the cooling devices described above, wherein one or both of the two stacks, as well as the hot heat exchanger and cold heat exchanger or/and the cooling heat exchanger and cooling output heat exchanger are constituted with fluid channels of different stack fluid channel lengths.

A fourteenth invention is any one of the cooling devices described above, wherein one or both of the two stacks, as well as the hot heat exchanger and cold heat exchanger or/and the cooling heat exchanger and cooling output heat exchanger, are constituted with fluid channels of longer fluid channel lengths near the center of the stack and fluid channels of shorter fluid channel lengths towards the periphery of the stack.

The inventions 7 through 14 are capable of improving the efficiency of the heat exchangers attached to the stacks, improving cooling efficiency, and achieving device miniaturization.

A fifteenth invention is a cooling device constituted by combining the cooling output heat exchanger of any of the cooling devices described above with the cooling heat exchanger of any other cooling device described above and joining a plurality of such combinations together. The fifteenth invention can improve cooling capacity and obtain lower temperatures.

BEST MODE FOR CARRYING OUT THE INVENTION

Hereinbelow, the present invention is explained in detail by referring to drawings.

Figure 1:
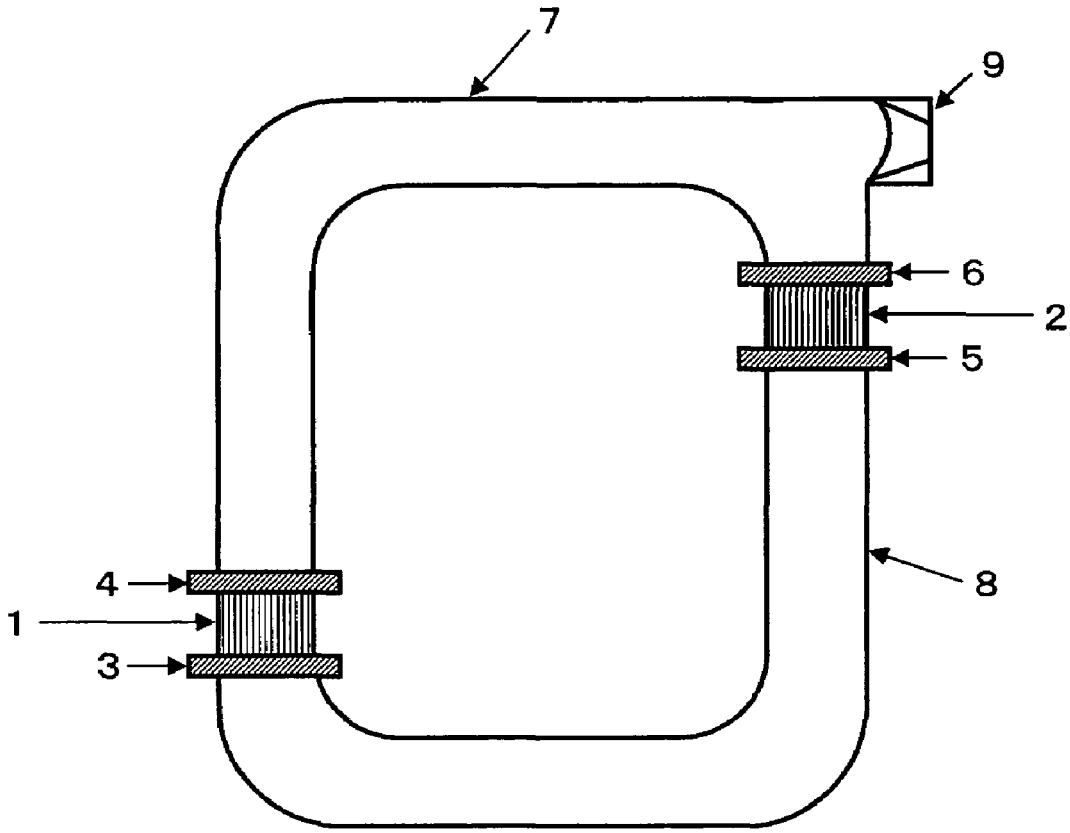
FIG. 1 is a schematic cross-sectional view showing an embodiment of a cooling device according to the present invention.

FIG. 1 is a schematic cross-sectional view showing an embodiment of a cooling and refrigerating device according to the present invention. In FIG. 1, a conduit is formed by interconnecting a stack 1 combining a hot heat exchanger 3 with a cold heat exchanger 4 and a stack 2 combining a cooling heat exchanger 5 with a cooling output heat exchanger 6 with the help of looped tubes 7 and 8 and by providing a single acoustic wave generator inside the looped tube 7, with a prescribed working fluid enclosed in the conduit. Although the stacks 1 and 2 are placed in practically symmetrical positions relative to the center of the device formed by the looped tubes 7 and 8 and are located such that the distances between the stacks 1 and 2 are practically the same, and, furthermore, even if it is more preferable for the positions of the stacks 1 and 2 to be in the vicinity of the end portions of the straight sections of the looped tubes, unlike the conventional technology, the present invention has no strict limitations regarding the positions of the stacks 1 and 2.

FIG. 1 provides an explanation of the thermoacoustic effect-based cooling effects according to the present invention. When a steep temperature gradient is formed by a hot end of a hot heat exchanger 3 and a cold end of a cold heat exchanger 4 in the stack 1, the formation of the steep temperature gradient causes the working fluid to oscillate. Subsequently, resonance is generated inside the looped tube as the working fluid undergoes strong oscillation, swirls and propagates inside the looped tube. In other words, a standing wave and a traveling wave are generated inside the looped tube. At the same time, forced generation of an acoustic wave of a prescribed frequency by an acoustic wave generator 9 markedly shortens, and stabilizes, the time until the start of generation of the standing wave and traveling wave inside the looped tube.

The acoustic wave generator 9 can enhance spontaneous oscillation, can markedly shorten the time until the start of generation of the standing wave and traveling wave and can provide stable control. As will be explained later, in the present invention, providing oscillation generators enables the same effects. The generated standing wave and traveling wave propagate in the direction from the hot heat exchanger 3 of the stack 1 towards the cold heat exchanger 5 of the stack 2. Due to changes in pressure and volume associated with the standing wave and traveling wave, the standing wave and traveling wave absorb heat in the process of expansion and the heat is pumped from the cooling output heat exchanger 6 to the cooling heat exchanger 5, thereby cooling the cooling output heat exchanger 6 and obtaining a cooling output. In the past, obtaining a high cooling output required reducing the frequencies of the standing wave and traveling wave, but reducing the frequencies required a longer time until the start of acoustic wave generation.

In addition, when the frequencies of the standing wave and traveling wave were reduced in order to shorten the time until the start of acoustic wave generation, sufficient cooling output was not obtained. Without reducing the frequencies more than necessary, the present invention can markedly shorten the time until the start of generation of the standing wave and traveling wave and can provide stable control, obtain the desired cooling output, and achieve increased efficiency.

With respect to the acoustic wave generator 9 of the present invention, FIG. 1 shows a preferred embodiment, in which a loudspeaker 1 is provided inside the looped tube; however, it may be provided inside, outside, or both inside and outside. It is preferable to provide a plurality of devices in prescribed positions at every ½-wavelength and ¼-wavelength of the generated standing wave and traveling wave. They may be provided in prescribed positions so as to enhance the resonance between the standing wave and traveling wave, shorten the time until the start of generation, and permit stable generation.

Figure 2:
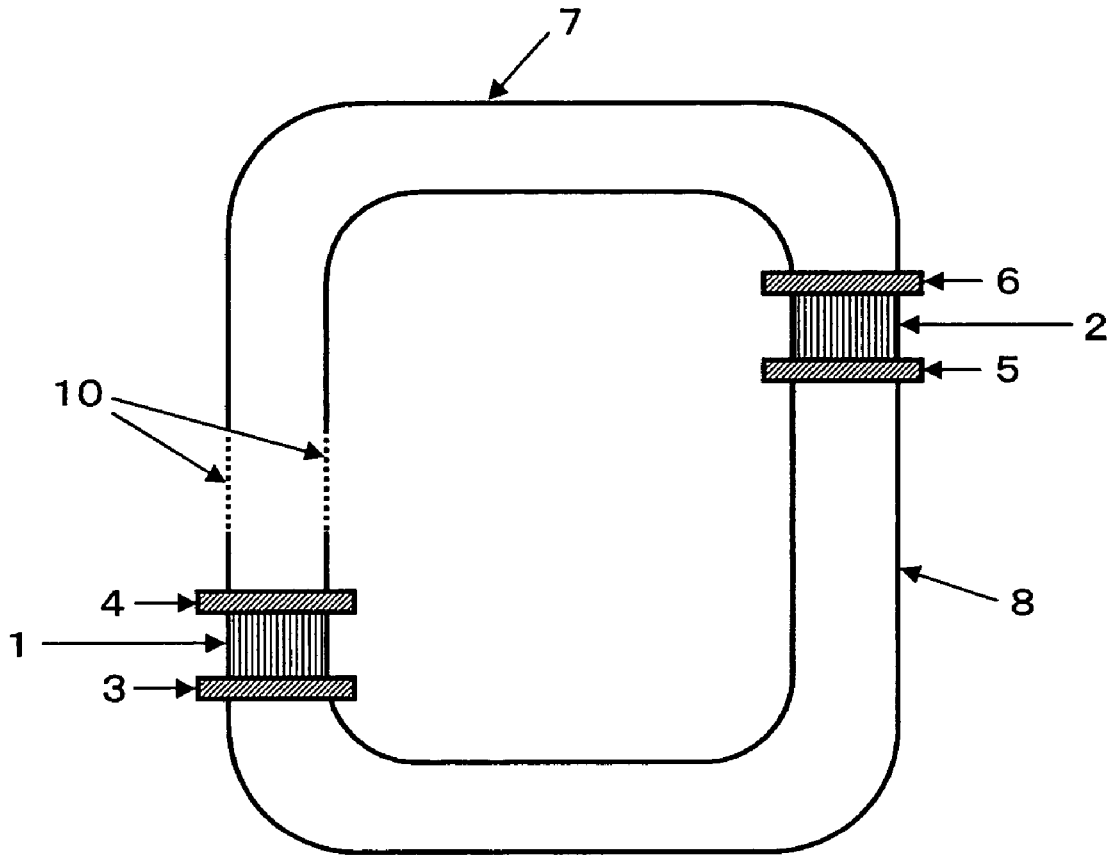
FIG. 2 is a schematic cross-sectional view showing another embodiment of the cooling device according to the present invention.
Figure 3:
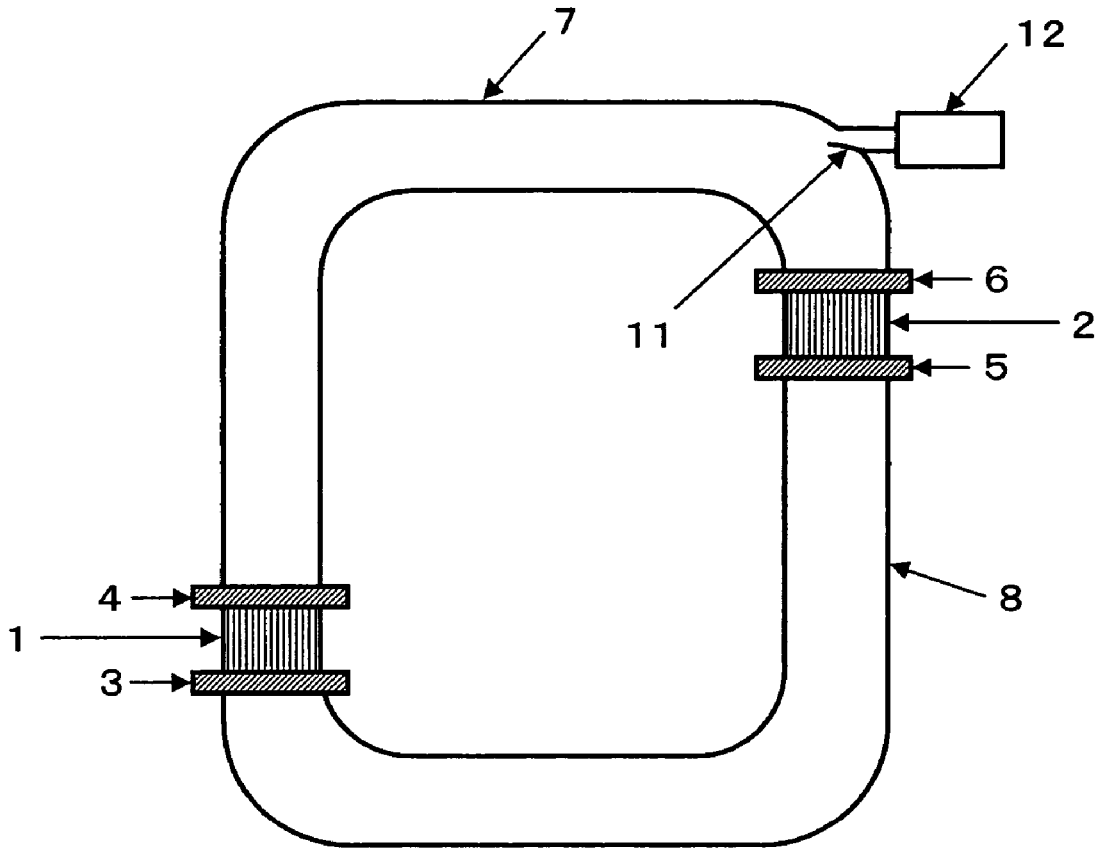
FIG. 3 is a schematic cross-sectional view showing yet another embodiment of the cooling device according to the present invention.

With regard to the acoustic wave generator 9, FIG. 2 shows an embodiment utilizing a piezoelectric film 10 of the present invention, and FIG. 3 shows an embodiment having formed therein an enclosure 12 holding the working fluid of the present invention. A flexible and strong piezoelectric film 10 made, for instance, of polyvinylidene (PVD) fluoride, serves as an acoustic wave generator and, at the same time, may form part or all of the looped tube. On the other hand, the working fluid contained in the working fluid enclosure 12 is placed in communication with the looped tube by turning a valve or a check valve 11 on and off and pvρ changes (p: pressure, v: volume, ρ: density) generated in the working fluid at such time enhance acoustic wave generation. As long as it can act on the working fluid to enhance the generation of the standing wave and traveling wave, the acoustic wave generator may also be, for instance, a resonator or another widely used device, or it can be installed in combination with such devices.

Figure 4:
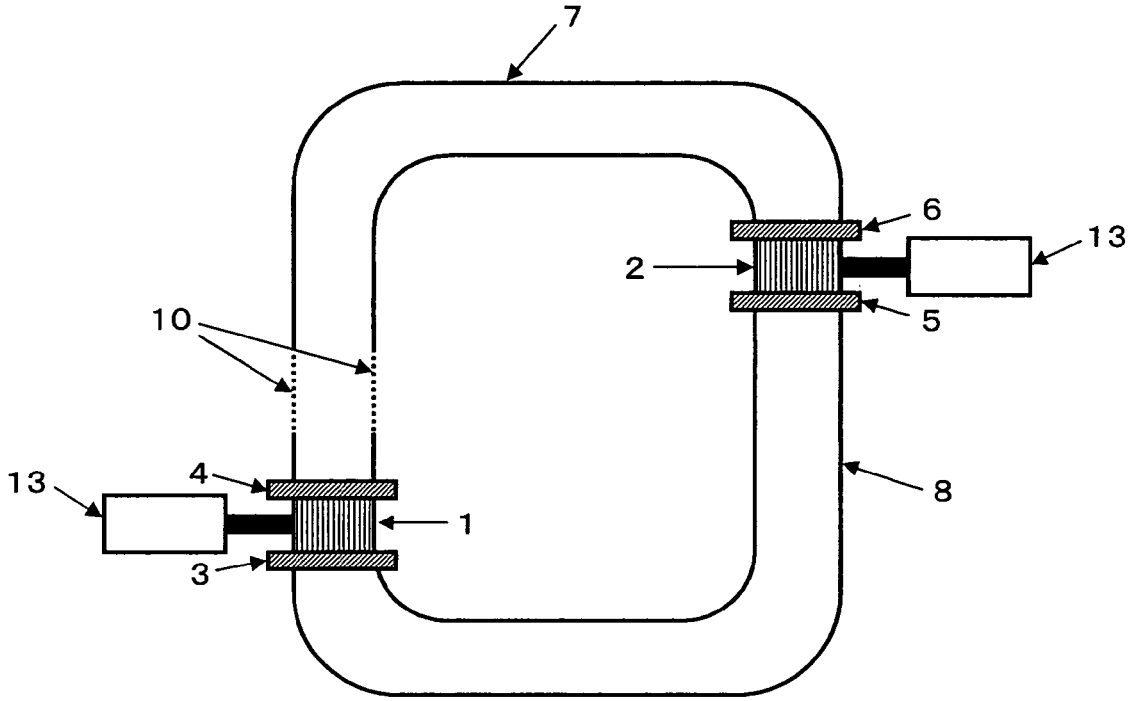
FIG. 4 is a schematic cross-sectional view showing still another embodiment of the cooling device according to the present invention with stacks having oscillation generators.

FIG. 4 shows an embodiment of the present invention, in which the stacks 1 and 2 are equipped with oscillation generators 13. The oscillation generators 13 act on the working fluid by imparting oscillations to the stacks 1 and 2 to enhance the generation of the standing wave and traveling wave. The effect is obtained even if a single oscillation generator is attached to one of the stacks, as the case may be. In addition, oscillation generators can be specifically implemented in a simple and convenient manner using piezoelectric elements. Furthermore, even more preferable are oscillation generators, in which the stacks themselves are constituted with piezoelectric elements. The oscillation generators act on the working fluid by oscillating the stacks to enhance the generation of the standing wave and traveling wave, with oscillating the stacks being most effective. However, there are no restrictions on the position or the portion of the thermoacoustic cooling device where the oscillation generators are provided.

Figure 5:
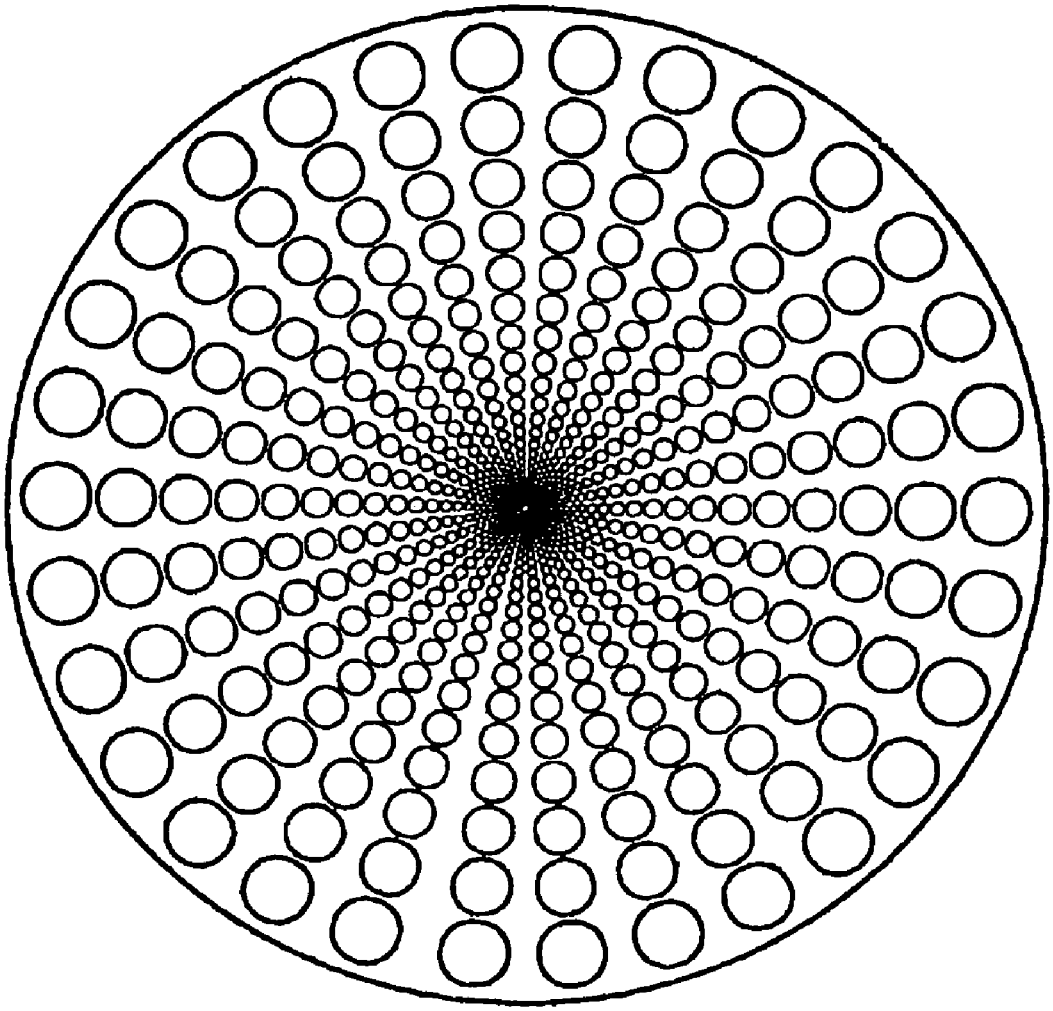
FIG. 5 is a schematic cross-sectional view of microchannel diameters showing an embodiment of the stack according to the present invention.

The stack 1 of the present invention generates a standing wave and traveling wave in the looped tube and the stack 2, conversely, performs an important function of the present invention, whereby the standing wave and traveling wave pump out the heat. The present invention has demonstrated that constituting the fluid channel cross sectional areas of the stacks 1 and 2 with different cross sectional areas improves spontaneous oscillation in the stack 1 and heat exchange efficiency in the stack 2. In addition, in a similar fashion, constituting the fluid channel cross sectional areas not only in the stacks 1 and 2, but also in all the heat exchangers (hot heat exchanger 3, cold heat exchanger 4, cooling heat exchanger 5, and cooling output heat exchanger 6) with different cross sectional areas improves spontaneous oscillation in the hot heat exchanger 3 and cold heat exchanger 4 as well as heat exchange efficiency in cooling heat exchanger 5 and cooling output heat exchanger 6. The fluid channel cross sectional area of the stacks 1 and 2, or of the stacks 1 and 2 and the heat exchangers 3, 4, 5, and 6, as shown in FIG. 5, is a preferred embodiment of the present invention of the stacks 1 and 2 or of stacks 1 and 2 and the heat exchangers 3, 4, 5, and 6, designed by making the fluid channel cross sectional area smaller in the vicinity of the central portion and making the fluid channel cross sectional area larger towards the peripheral portion, with FIG. 5 being a schematic cross sectional view perpendicular to the looped tube. Also, conversely to the above, the fluid channel cross sectional area of the stacks 1 and 2, or that of the stacks 1 and 2 and the heat exchangers 3, 4, 5, and 6 may be such that the fluid channel cross sectional area is made larger in the vicinity of the central portion while making the fluid channel cross sectional area smaller towards the peripheral portion.

Figure 6:
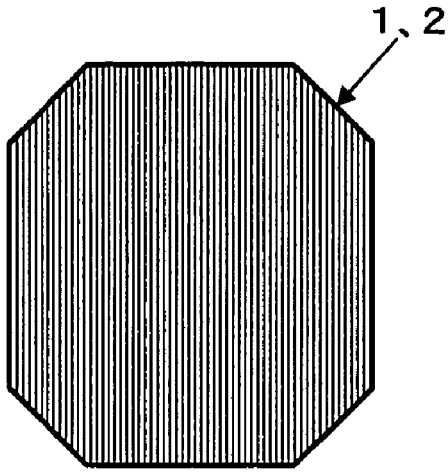
FIG. 6 is a schematic cross-sectional view of microchannel lengths showing an embodiment of the stacks according to the present invention.

Furthermore, it has been found that constituting the stacks 1 and 2 with different fluid channel lengths improves spontaneous oscillation in the stack 1 and heat exchange efficiency in the stack 2. The stacks 1 and 2, as shown in FIG. 6, represent a preferred embodiment of the stacks 1 and 2 designed by making the fluid channel length longer in the vicinity of the central portion and making the fluid channel length shorter towards the periphery, with FIG. 6 being a schematic cross sectional view parallel to the axis of the looped tube. Stacks 1 and 2 are more preferable when designed to incorporate both the fluid channel cross sectional areas and fluid channel lengths described above. The magnitude of the cross sectional areas of the fluid channels of the stacks 1 and 2 and their in-plane distribution, as well as the length of the fluid channel lengths and their shape/distribution are inter-related with the type of the working fluid and its physical properties as well as with the type and properties of the material of the stacks and are designed based on them. Improving the spontaneous oscillation and heat exchange efficiency of the stacks 1 and 2 has made it possible to shorten of the time until the start of cooling and achieve miniaturization. Ceramics, metal, steel, etc., as well as porous and laminated materials made therefrom, can be widely used as materials for fabricating the stacks 1 and 2 described above. Also, unlike the above stacks 1 and 2 shown in FIG. 6, the fluid channel lengths may be made shorter in the vicinity of the central portion of the stacks while making the fluid channel lengths longer towards the periphery.

Figure 7:
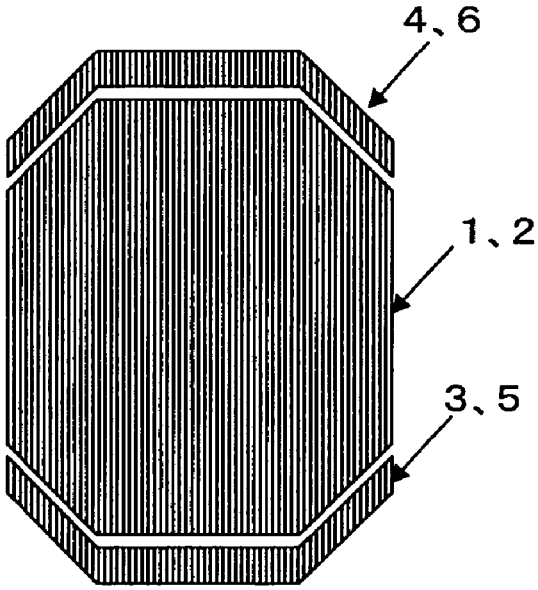
FIG. 7 is a schematic cross-sectional view of microchannel lengths showing an embodiment of the stacks and heat exchangers according to the present invention.

Furthermore, it has been found that constituting not only the stacks 1 and 2, but also the heat exchangers 3, 4, 5, and 6 with different fluid channel lengths improves spontaneous oscillation in the stack 1 and in the heat exchangers 3 and 4, as well as heat exchange efficiency in the stack 2 and in the heat exchangers 5 and 6. The stacks 1 and 2 and the heat exchangers 3, 4, 5, and 6 shown in FIG. 7 represent a preferred embodiment of the stacks and the heat exchangers designed by making the fluid channel lengths longer in the vicinity of the central portion and making the fluid channel lengths shorter towards the periphery, with FIG. 7 being a schematic cross sectional view parallel to the axis of the looped tube. Stacks 1 and 2 and heat exchangers 3, 4, 5, and 6 are more preferable when designed to incorporate both the fluid channel cross sectional areas and fluid channel lengths described above. The magnitude of the cross sectional areas of the fluid channels of the stacks 1 and 2 and heat exchangers 3, 4, 5, and 6 and their in-plane distribution, as well as the lengths of the fluid channel lengths and their shape/distribution are interrelated with the type of the working fluid and its physical properties as well as with the type and properties of the material of the stacks and are designed based on them. Improving the spontaneous oscillation and heat exchange efficiency of the stacks 1 and 2 and heat exchangers 3, 4, 5, and 6 has made it possible to shorten the time until the start of cooling and achieve miniaturization. Ceramics, metal, steel, etc., as well as porous and laminated materials made therefrom, can be widely used as materials for fabricating the stacks 1 and 2 described above. In addition, materials possessing high thermal conductivity, such as copper, nickel, etc, are suitable as materials for fabricating the heat exchangers. Also, conversely to the above, the fluid channel lengths may be made shorter in the vicinity of the central portion of the stacks 1 and 2 and heat exchangers 3, 4, 5, and 6 while making the fluid channel lengths longer towards the periphery.

In addition, as explained above, by imparting oscillations, the stacks of the present invention provided with oscillation generators 13 (FIG. 4) act on the working fluid to enhance the generation of the standing wave and traveling wave, and, at the same time, the stacks convert the standing wave and traveling wave to heat and improve heat conversion efficiency. The heat conversion efficiency can be improved even more if the preferred stacks of the present invention shown in FIG. 5 and FIG. 6 above are provided with the oscillation generators. In addition, the oscillation generators, in which the stacks themselves are constituted with piezoelectric elements, improve the efficiency of heat conversion and, at the same time, enable device miniaturization.

Figure 8:
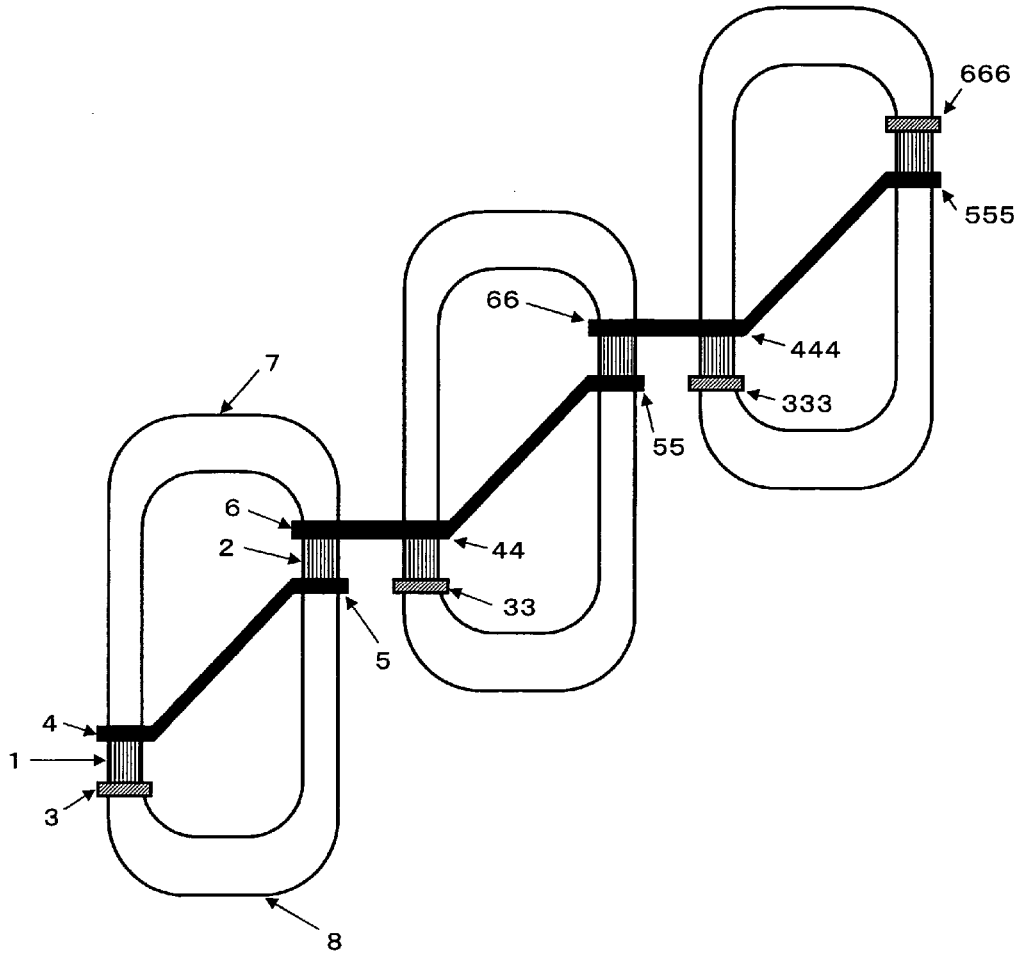
FIG. 8 is a schematic cross-sectional view showing an embodiment of a multi-stage cooling device according to the present invention.

FIG. 8 is a schematic cross-sectional view showing an embodiment of the multi-stage thermoacoustic cooling device of the present invention. The multi-stage thermoacoustic cooling device of the present invention is characterized in that it is constituted by combining the cooling output heat exchanger 6 of the thermoacoustic cooling device described above with the cooling heat exchanger 44 of another thermoacoustic cooling device described above and joining a plurality of such combinations together. Therefore, in case of the embodiment of FIG. 7, the resulting final cooling output is obtained from a cooling output heat exchanger 666, with the attained cooling temperature being such that the temperature obtained in the cooling output heat exchanger 66 is lower than the temperature obtained in the cooling output heat exchanger 6, and, furthermore, the temperature obtained in the cooling output heat exchanger 666 is even lower than that. In addition, the combined cooling devices may be constituted with absolutely identical devices, or they may be constituted with various different cooling devices described in the present invention.

The hot end of the hot heat exchanger 3 described above is formed with the help of a heater or hot water utilizing waste heat. In case of the thermoacoustic cooling device of the present invention, utilizing waste heat is not only good for the environment, but it is also advantageous from the standpoint that under normal conditions the stack 1 is operated using low output cooling and refrigerating output generated by self-excitation, while a high output cooling output is instantaneously obtained by operating the acoustic wave generator as necessary. The cold end of the cold heat exchanger 4 is formed with the help of regular normal-temperature tap water, etc. In addition, the cooling heat exchanger 5 of the stack 2 is either connected to the cold heat exchanger 4 or is independently cooled using the same type of media as the cold heat exchanger 4. The cooling output heat exchanger 6 is cooled and heat energy is transported by the medium to cooling and refrigeration sections, thereby achieving the goal. As concerns the heat exchangers 3, 4, 5 and 6 used herein, copper, stainless steel, etc., as well as mesh-like, spherical, plate-shaped and other materials and shapes are the ones that are used in the art, and are not particularly limited. In addition, the media are those used in the art, such as water, oil, glycols, brine, etc., and are not particularly limited.

Inert gases, such as nitrogen, helium and argon, mixtures of helium and argon, etc., as well as air, can be used as the working fluid described above. In general, working fluids with a smaller Prandtl Number are considered to be more efficient. In addition, while the working fluids may be at normal pressure, a pressure of 0.1 to 1 MPa is preferred, although there are no particular limitations.

Below, the present invention is explained more specifically with reference to embodiments; the present invention, however, is not limited thereto.

EXAMPLES

An embodiment of the cooling device shown in FIG. 1 is explained specifically below. The looped tubes 7 and 8 were formed using copper tubes with an inner diameter of 45 mm and a thickness of 3 mm, in which the longer of the straight sections was 950 mm long and the shorter one was 450 mm long, with the longer and shorter copper pipes welded together using copper elbows so as to obtain a radius of curvature of 50 mm. The two stacks 1 and 2 were formed using ceramic pieces with a diameter of 45 mm and a length of 50 mm, in which #1200 (1200 ducts/square inch) microchannels were formed. In the hot heat exchanger 3, a hot end was formed by supplying 360 W electric power using a 30Ω sheathed heater with a diameter of 1.6 mm and a length of 1000 mm, while in the cold heat exchanger 4 and cooling heat exchanger 5 cold ends were formed by cooling a 20-mesh copper net with 15° C. circulating water at a flow rate of 0.6 l/sec. The stack 1 combined heat exchangers 3 and 4 and the stack 2 combined heat exchangers 3 and 4, with the two installed equidistantly from one another inside the loop conduit. In addition, a loudspeaker 8 was installed inside the conduit and a mixture of air and He at 0.1 MPa was enclosed in the conduit as the working fluid. It was confirmed that a standing wave and traveling wave were generated approximately one second after bringing the temperature of the hot end to about 400° C. by supplying electric power to the heat exchanger 3 and then causing the loudspeaker to generate oscillations at 100 Hz. As a result, the heat exchanger 6 could be cooled from room temperature, i.e. 24° C., down to 7° C.

INDUSTRIAL APPLICABILITY

The cooling device of the present invention is useful as a thermoacoustic effect-based cooling device that shortens the time until the start of cooling and improves efficiency.

The invention claimed is:

1. A cooling device comprising:

a stack combining a hot heat exchanger with a cold heat exchanger;

a stack combining a cooling heat exchanger with a cooling output heat exchanger;

a looped tube formed by interconnecting the two ends of the two stacks;

and an acoustic wave generator installed outside or/and inside the looped tube, wherein cooling is effected by forming a conduit, by enclosing a working fluid in the conduit, and by generating a standing wave and a traveling wave in the working fluid, and the acoustic wave generator generates an acoustic wave in a predetermined frequency by force and substantially simultaneously generates the standing wave and the traveling wave inside the looped tube.

2. The cooling device according to claim 1,
wherein the acoustic wave generator constitutes part or all of the looped tube.

3. The cooling device according to claim 1,
wherein the acoustic wave generator is made of a piezoelectric film.

4. A cooling device, comprising:
a stack combining a hot heat exchanger with a cold heat exchanger;
a stack combining a cooling heat exchanger with a cooling output heat exchanger;
a looped tube formed by interconnecting the two ends of the two stacks;
and an acoustic wave generator installed outside or/and inside the looped tube,
wherein cooling is effected by forming a conduit, by enclosing a working fluid in the conduit, and by generating a standing wave and a traveling wave in the working fluid, and
the acoustic wave generator has an enclosure provided such that the working fluid, which has a pressure difference relative to the pressure inside the looped tube, is placed in communication with the looped tube through a valve or a check valve.

5. The cooling device according to claim 1,
wherein one or both of the two stacks have oscillation generators.

6. The cooling device according to claim 5,
wherein the oscillation generators are constituted with piezoelectric elements.

7. A cooling device comprising;
a stack combining a hot heat exchanger with a cold heat exchanger;
a stack combining a cooling heat exchanger with a cooling output heat exchanger;
a looped tube formed by interconnecting the two ends of the two stacks;
and an acoustic wave generator installed outside or/and inside the looped tube,
wherein cooling is effected by forming a conduit, by enclosing a working fluid in the conduit, and by generating a standing wave and a traveling wave in the working fluid, and
one or both of the two stacks are constituted with piezoelectric elements.

8. A cooling device comprising:
a stack combining a hot heat exchanger with a cold heat exchanger;
a stack combining a cooling heat exchanger with a cooling output heat exchanger;
a looped tube formed by interconnecting the two ends of the two stacks;
and an acoustic wave generator installed outside or/and inside the looped tube,
wherein cooling is effected by forming a conduit, by enclosing a working fluid in the conduit, and by generating a standing wave and a traveling wave in the working fluid, and
one or both of the two stacks are constituted with fluid channels of different fluid channel cross-sectional areas.

9. A cooling device comprising:
a stack combining a hot heat exchanger with a cold heat exchanger;
a stack combining a cooling heat exchanger with a cooling output heat exchanger;
a looped tube formed by interconnecting the two ends of the two stacks;
and an acoustic wave generator installed outside or/and inside the looped tube,
wherein cooling is effected by forming a conduit, by enclosing a working fluid in the conduit, and by generating a standing wave and a traveling wave in the working fluid, and
one or both of the two stacks are constituted with fluid channels of smaller fluid channel cross-sectional areas near the center of the stack and fluid channels of larger fluid channel cross-sectional areas towards the periphery of the stack.

10. A cooling device comprising:
a stack combining a hot heat exchanger with a cold heat exchanger;
a stack combining a cooling heat exchanger with a cooling output heat exchanger;
a looped tube formed by interconnecting the two ends of the two stacks;
and an acoustic wave generator installed outside or/and inside the looped tube,
wherein cooling is effected by forming a conduit, by enclosing a working fluid in the conduit, and by generating a standing wave and a traveling wave in the working fluid, and
one or both of the two stacks, as well as the hot heat exchanger and cold heat exchanger or/and the cooling heat exchanger and cooling output heat exchanger are constituted with fluid channels of different fluid channel cross sectional areas.

11. A cooling device comprising:
a stack combining a hot heat exchanger with a cold heat exchanger;
a stack combining a cooling heat exchanger with a cooling output heat exchanger;
a looped tube formed by interconnecting the two ends of the two stacks;
and an acoustic wave generator installed outside or/and inside the looped tube,
wherein cooling is effected by forming a conduit, by enclosing a working fluid in the conduit, and by generating a standing wave and a traveling wave in the working fluid, and
one or both of the two stacks, as well as the hot heat exchanger and cold heat exchanger or/and the cooling heat exchanger and cooling output heat exchanger, are constituted with fluid channels of smaller fluid channel cross sectional areas near the center of the stack and fluid channels of larger fluid channel cross-sectional areas towards the periphery of the stack.

12. A cooling device comprising:
a stack combining a hot heat exchanger with a cold heat exchanger;
a stack combining a cooling heat exchanger with a cooling output heat exchanger;
a looped tube formed by interconnecting the two ends of the two stacks;
and an acoustic wave generator installed outside or/and inside the looped tube,
wherein cooling is effected by forming a conduit, by enclosing a working fluid in the conduit, and by generating a standing wave and a traveling wave in the working fluid, and
one or both of the two stacks are constituted with fluid channels of different stack fluid channel lengths.

13. A cooling device comprising:
a stack combining a hot heat exchanger with a cold heat exchanger;

a stack combining a cooling heat exchanger with a cooling output heat exchanger;

a looped tube formed by interconnecting the two ends of the two stacks;

and an acoustic wave generator installed outside or/and inside the looped tube, wherein cooling is effected by forming a conduit, by enclosing a working fluid in the conduit, and by generating a standing wave and a traveling wave in the working fluid, and one or both of the two stacks are constituted with fluid channels of longer fluid channel lengths near the center of the stack and fluid channels of shorter fluid channel lengths towards the periphery of the stack.

14. A cooling device comprising:

a stack combining a hot heat exchanger with a cold heat exchanger;

a stack combining a cooling heat exchanger with a cooling output heat exchanger;

a looped tube formed by interconnecting the two ends of the two stacks;

and an acoustic wave generator installed outside or/and inside the looped tube, wherein cooling is effected by forming a conduit, by enclosing a working fluid in the conduit, and by generating a standing wave and a traveling wave in the working fluid, and one or both of the two stacks, as well as the hot heat exchanger and cold heat exchanger or/and the cooling heat exchanger and cooling output heat exchanger, are constituted with fluid channels of different stack fluid channel lengths.

15. A cooling device comprising:

a stack combining a hot heat exchanger with a cold heat exchanger;

a stack combining a cooling heat exchanger with a cooling output heat exchanger;

a looped tube formed by interconnecting the two ends of the two stacks;

and an acoustic wave generator installed outside or/and inside the looped tube, wherein cooling is effected by forming a conduit, by enclosing a working fluid in the conduit, and by generating a standing wave and a traveling wave in the working fluid, and one or both of the two stacks, as well as the hot heat exchanger and cold heat exchanger or/and the cooling heat exchanger and cooling output heat exchanger, are constituted with fluid channels of longer fluid channel lengths near the center of the stack and fluid channels of shorter fluid channel lengths toward the periphery of the stack.

16. A cooling device formed by combining a cooling output heat exchanger of the cooling devices described in claim 1 with a cooling heat exchanger of cooling device described in claim 1 and joining a plurality of such combinations together.

* * * * *